United States Patent [19]

Kambe et al.

[11] Patent Number: 4,995,796

[45] Date of Patent: Feb. 26, 1991

[54] MULTI-SECTION ROOTS VACUUM PUMP OF REVERSE FLOW COOLING TYPE

[75] Inventors: Shigeharu Kambe, Kawasaki; Tutomu Higuchi, Yokohama, both of Japan

[73] Assignee: Unozawa - Gumi Iron Works, Ltd., Tokyo, Japan

[21] Appl. No.: 400,993

[22] Filed: Aug. 31, 1989

[30] Foreign Application Priority Data

Sep. 5, 1988 [JP] Japan ..... 63-220496

[51] Int. Cl.[5] ..... F04C 23/00; F04C 25/02; F04C 29/04

[52] U.S. Cl. ..... 418/9; 418/86; 418/15

[58] Field of Search ..... 418/9, 10, 15, 83, 86; 417/243

[56] References Cited

U.S. PATENT DOCUMENTS

| | | | |
|---|---|---|---|
| 2,489,887 | 11/1949 | Houghton | 418/86 |
| 2,648,488 | 8/1953 | Paget | 418/9 X |
| 3,405,604 | 10/1968 | Lysholm | 418/86 X |
| 3,667,874 | 6/1972 | Weatherston et al. | 418/9 |
| 3,922,117 | 11/1975 | Weatherston | 418/9 |
| 4,102,615 | 7/1978 | Irgens | 418/86 |
| 4,789,314 | 12/1988 | Higuchi et al. . | |

FOREIGN PATENT DOCUMENTS 115489 7/1984 Japan .

*Primary Examiner*—Michael Koczo

*Attorney, Agent, or Firm*—Merchant, Gould, Smith, Edell, Welter & Schmidt

[57] ABSTRACT

A multi-section Roots vacuum pump of the reverse-flow cooling type having a plurality of pump sections each having rotors fixed to two common shafts. The pump includes a housing in each of the pump sections having an inlet and an outlet for a gas to be pumped and enclosing the rotors, a peripheral gas passages arranged around the housing, and a peripheral coolant water passages arraged around the peripheral gas passages. The gas flowing through the inlet into the housing and delivered through the outlet is supplied to the peripheral gas passages to be cooled there, and at least a portion of the cooled gas is returned into the housing. The remaining portions of the gas which are not returned into the housing in the pump sections except for the last pump section are supplied to the inlet of the next pump section through the peripheral gas passage.

1 Claim, 5 Drawing Sheets

MULTI-SECTION ROOTS VACUUM PUMP OF REVERSE FLOW COOLING TYPE

BACKGROUND OF THE INVENTION

1. Field of the Invention

The present invention relates to a multi-section Roots vacuum pump of the reverse flow cooling type with internal coolant water passages. The present invention is applicable to a reverse flow cooling type multi-section Roots vacuum pump which is operated at a high compression ratio in the range from atmospheric pressure to $10^{-3}$ Torr at a relatively high temperature.

2. Description of the Related Arts

In general, in a Roots type vacuum pump in which rotor pairs rotating in a housing to draw in and discharge gas have a minute clearance from the housing which accommodates the rotor pairs therein, it is important that the clearance between the rotor and the housing be as small as possible in order to realize a pump having a high performance.

In a prior art multi-section Roots vacuum pump driven at a high compression ratio, the temperature will rise relatively high due to the compression heat during operation, and a jacket is arranged directly around the housing which accommodates the rotor pairs therein, to protect the pump from superheating by coolant water running through the jacket for cooling the pump by the radiation of compression heat to the open air. However, since the housing is directly cooled by coolant water, the temperature of the housing in the operating state of the pump becomes significantly low in contrast to the temperature of the rotor pairs inside the housing, thus the clearance between the housing and the rotor pairs is reduced because the amount of thermal expansion of the housing becomes smaller than the amount of thermal expansion of the rotor pairs, and there is a possibility of a contact between the housing and the rotor. To prevent such contact from occurring, the clearance between the housing and the rotor pairs should be preset larger than preferred. This situation is an obstacle to the realization of a pump having a high performance by minimizing the amount of gas leakage from the clearance mentioned above.

Further, as disclosed, in another prior art reverse flow cooling type multi-section Roots vacuum pump, the pump includes a connection pipe provided to connect the outlet passage of a specific pump section with the inlet passage of the following pump section, a cooler incorporated to the connection pipe, and a reverse flow pipe branched off from the connection pipe at the downstream side of the cooler and arranged to lead the reverse flow cooling gas to the preceding pump section. Reference can be made to Japanese Unexamined Patent Publication (Kokai) No. 59-115489, and Japanese Unexamined Patent Publication (Kokai) No. 63-154884.

In the reverse flow cooling type multi-section Roots vacuum pump, a plurality of external coolers is provided for cooling gas running through the connection pipe to protect the pump from superheating by radiating compression heat produced at each pump section. Further, an external piping arranged outside the pump consists of connection pipes for connecting the outlet of each pump section and the inlet of the following pump section, and reverse flow pipes branched off from the connection pipes for leading reverse flow of coolant gas to the preceding side pump section. Therefore, this relatively complicated structure of the external piping arrangement is not advantageous from the viewpoints of compactness of the pump and manufacturing cost of both the external cooler and the external piping. Accordingly, a realization of a small sized pump having a high operation performance has been strongly desired.

SUMMARY OF THE INVENTION

An object of the present invention is to improve the performance of a reverse flow cooling type multi-section Roots vacuum pump by minimizing the amount of gas leakage through the clearance between the housing and the rotor pairs, in which an appropriate reverse flow cooling is carried out to remove the compression heat of gas, and at the same time, to cool the pump to a temperature low enough to protect the pump from overheating, without using a special external cooler, and the temperature gradient between the housing and the rotor pairs located in the housing is kept to a minimum while the pump is running, and the difference between the amounts of thermal expansion of the housing and the rotors is reduced to a minimum, and thus the clearance between the housing and the rotors can be set at a practically minimal value, resulting in a minimal amount of gas leakage through the clearance, and accordingly to attain the high performance of a much improved reverse flow cooling type multi-section Roots vacuum pump.

Another object of the present invention is to realize a miniaturization of the pump and a significant reduction of the cost for manufacturing the pump, in which a cooler installed outside the pump, connection pipes for connecting the outlet of each pump section and the inlet of the following pump section arranged as a part of the external piping, and reverse flow pipes branched from the connection pipes to lead reverse flow cooling gas to the preceding side pump section are eliminated, thus eliminating the cost for manufacturing the external coolers and the piping.

In accordance with the present invention, there is provided a multi-section Roots vacuum pump having a plurality of pump sections each having rotors fixed to two common shafts, the pump including a housing in each of the pump sections having an inlet and an outlet for a gas to be pumped and enclosing the rotors, peripheral gas passages arranged around the housing, peripheral coolant water passages arranged around the peripheral gas passages in which the gas flowing through the inlet into the housing and delivered through the outlet is supplied to the peripheral passages to be cooled there, and at least a portion of the cooled gas is returned into the housing, and the remaining portions of the gas which are not returned into the housing in the pump sections except for the last pump section are supplied to the inlet of the next pump section through the peripheral gas passage.

The operation of the vacuum pump according to the present invention will be described below.

The gas drawn in through the inlet of each pump section to the housing is transmitted by the rotation of the rotors. In this case, gas is compressed in the housing at a temperature having only a minimal rise due to the effect of reverse flow cooling gas which passes through the peripheral gas passage and flows into the housing through the inlet for reverse flow cooling gas, and then the compressed gas is discharged to the peripheral gas passage through the outlet. The discharged gas flows through the peripheral gas passage while radiating heat to the outside wall of the peripheral gas passage which is sufficiently cooled by coolant water circulated in the coolant water passage, and maintaining the housing at an appropriate warm temperature. The discharged gas is then divided into two portions at the inlet for reverse flow cooling gas: one portion is for reverse flow cooling gas which returns into the housing, and another portion is for intake gas which is delivered into the next pump section. The intake gas continuously flows through the peripheral gas passage while radiating heat to the outside wall of the peripheral gas passage which is sufficiently cooled by coolant water circulating in the coolant water passage, and also maintaining the housing at an appropriate temperature, to the inlet of the next pump section.

In the reverse flow cooling type multi-section Roots vacuum pump according to the present invention, a sufficient flow of the reverse flow coolant gas is secured due to the pressure difference between the suction pressure and the discharge pressure of the pump sections. A circulation of the reverse flow cooling gas successively flowing through the inlet, inside of the housing, the outlet, and the peripheral gas passage, forms a cycle for alternating heat built-up due to the compression in the housing and heat radiation carried out in the peripheral gas passage so that compression heat produced in the housing is always removed to the outside of the housing while the housing is kept at an appropriate warm temperature, and thus the difference in temperature of the housing and the temperature of the rotors located in the housing is maintained at a minimum.

On the other hand, gas drawn through the inlet of the following pump section radiates heat to the outside wall of the peripheral gas passage when such gas flows through the peripheral gas passage located between the outside wall of the passage and the housing, and at the same time gas protects the housing from being directly cooled by coolant water so as to keep the housing at an appropriate warm temperature, and thus the difference of temperature of the rotors located in the housing and the temperature of the housing is maintained at a minimum, and gas is delivered to the inlet of the next pump section. The same operation is successively performed at each pump section.

DESCRIPTION OF THE PREFERRED EMBODIMENTS

Before describing the preferred embodiments of the present invention, a prior art Roots vacuum and a prior art reverse flow cooling type multi-section Roots vacuum pump are described with reference to FIGS. 1 and 2.

Figure 1:
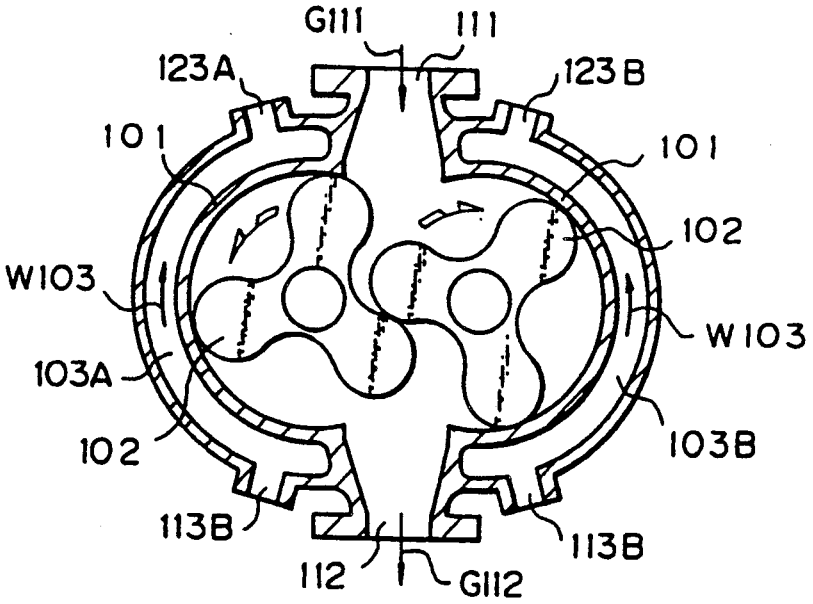
Fig. 1 (PRIOR ART)
FIG. 1 shows an example of a prior art Roots vacuum pump.

In particular, in the multi-section Roots vacuum pump shown in FIG. 1, driven at a high compression ratio, wherein the temperature will rise relatively high due to the compression heat during the operation, a jacket 103A, 103B for coolant water is provided at the peripheral portion of the housing 101 having rotor pairs 102 therein in order to radiate the compression heat to the open air, and the pump is cooled by coolant water W103 running through the jacket 103A, 103B.

Further, in general, a reverse flow cooling type multi-section Roots vacuum pump has been disclosed, in which the pump includes a connection pipe provided to connect the outlet passage of a specific pump section with the inlet passage of the following pump section, a cooler incorporated to the connection pipe, and a reverse flow pipe branched off from the connection pipe at the downstream side of the cooler and arranged to lead the reverse flow cooling gas to the preceding pump section.

Figure 2:
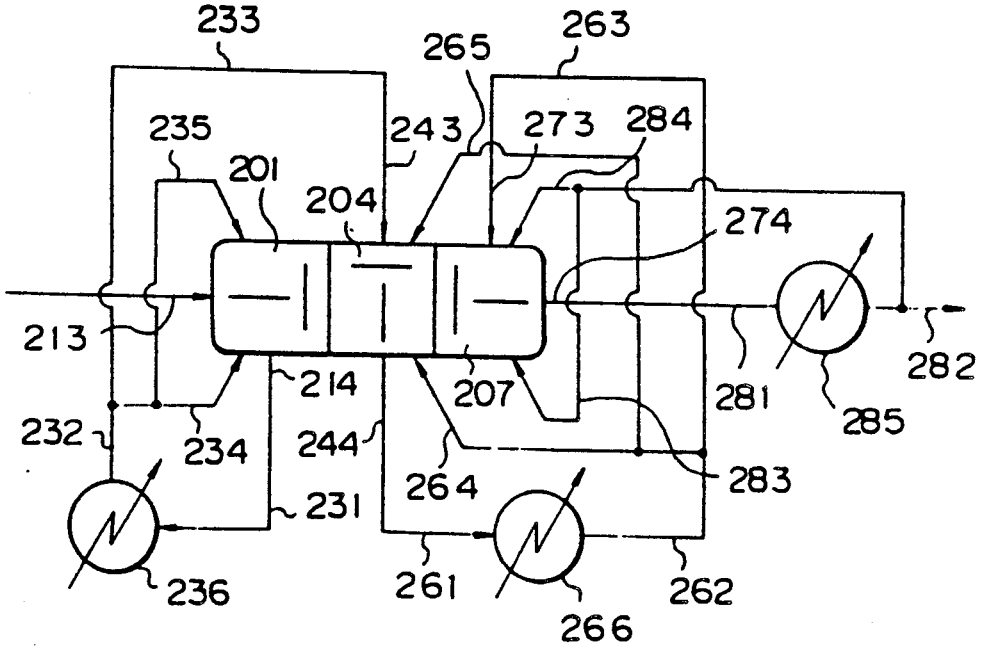
Fig. 2 (PRIOR ART)
FIG. 2 shows an example of a prior art reverse flow cooling type Roots vacuum pump.

In the 3-section Roots vacuum pump shown in FIG. 2, an outlet passage 214 of the first pump section 201 is connected to an inlet passage 243 of the second pump section 204 by connection pipes 231, 232, and 233, a cooler 236 is incorporated between connection pipes 231 and 232, and also reverse flow pipes 234 and 235 are branched off from the connection pipe 232 and are provided to lead reverse flow cooling gas to the housing of the first pump section 201. In the same manner, an outlet passage 244 of the second pump section 204 is connected to an inlet passage 273 of the third pump section 207 by the connection pipes 261, 262, and 263, a cooler 266 is incorporated between the connection pipes 261 and 262, and the reverse flow pipes 264 and 265 are branched off from the connection pipe 262 and are provided to lead reverse flow cooling gas to the housing of the second pump section 204. Likewise, the outlet pipes 281 and 282 are connected to the outlet passage 274 of the third pump section 207, with a cooler 285 incorporated between the outlet pipes 281 and 282, and the reverse flow pipes 283 and 284 are provided in a bifurcated manner from the outlet pipe 282 to the housing of the third pump section 207.

Figure 3:
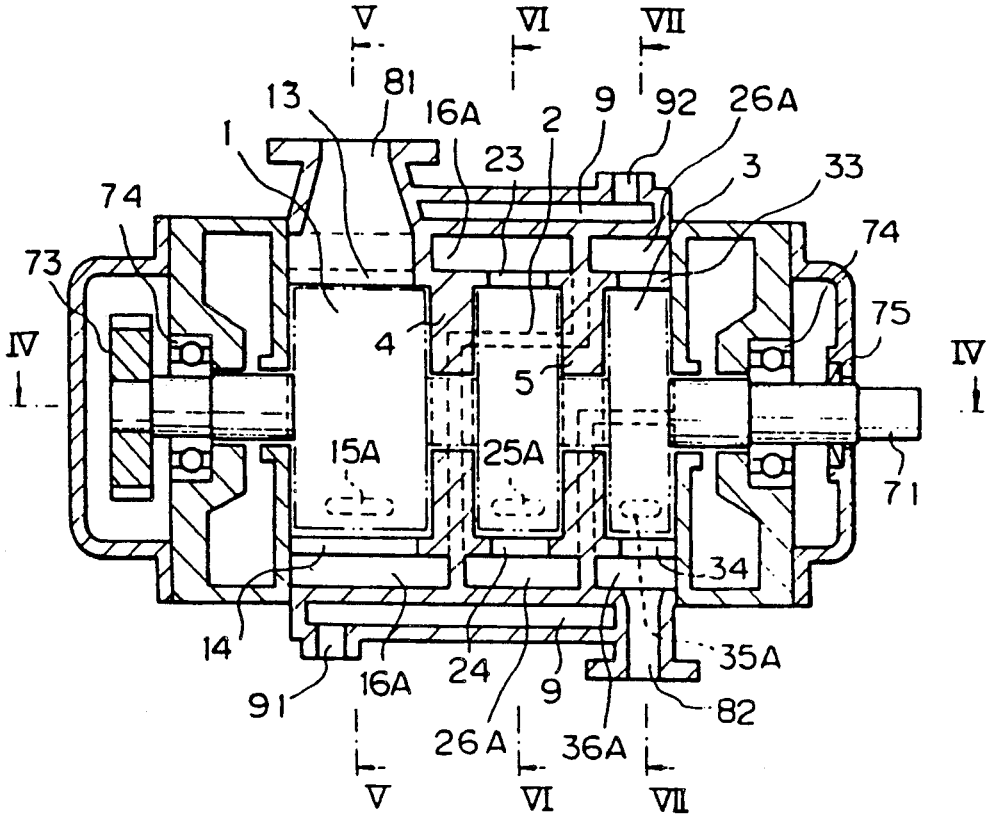
FIG. 3 shows a reverse flow cooling type three-section Roots vacuum pump according to an embodiment of the present invention.
Figure 4:
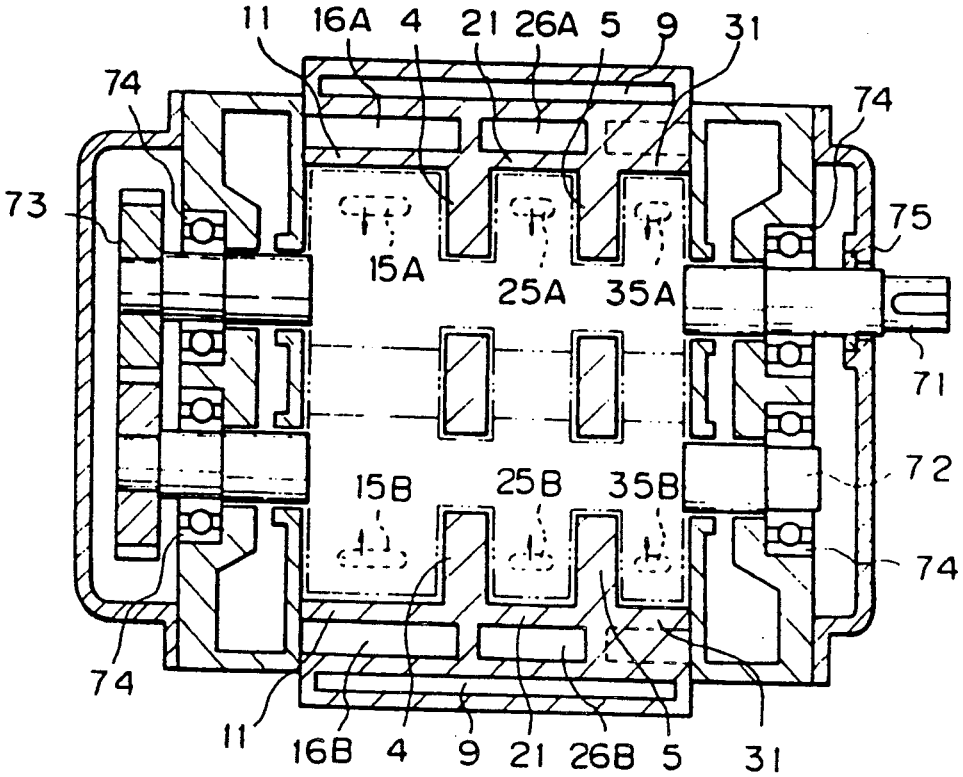
FIG. 4 is a cross-sectional view of the pump taken along the plane represented by the line IV—IV in FIG. 3.
Figure 5:
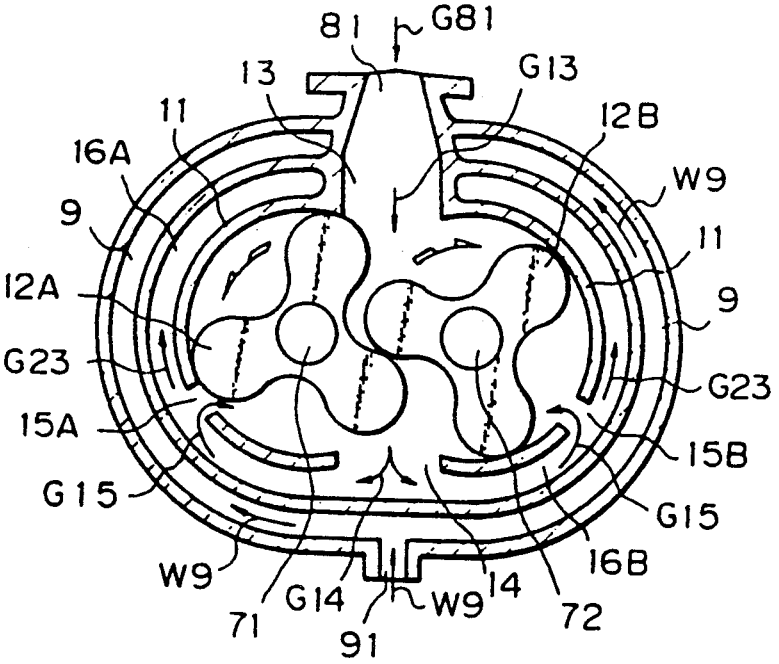
FIGS. 5 to 7 are cross-sectional views taken along the planes represented by V—V, VI—VI, and VII—VII in FIG. 3.
Figure 6:
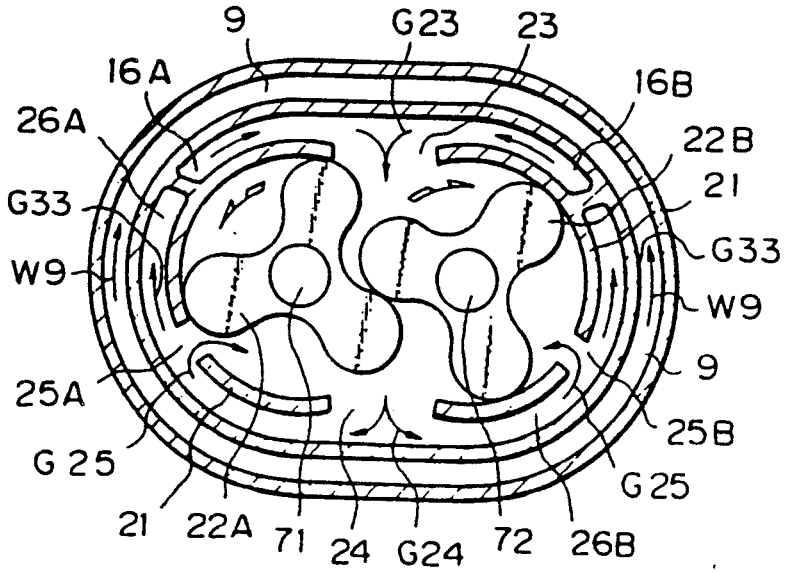
Figure 7:
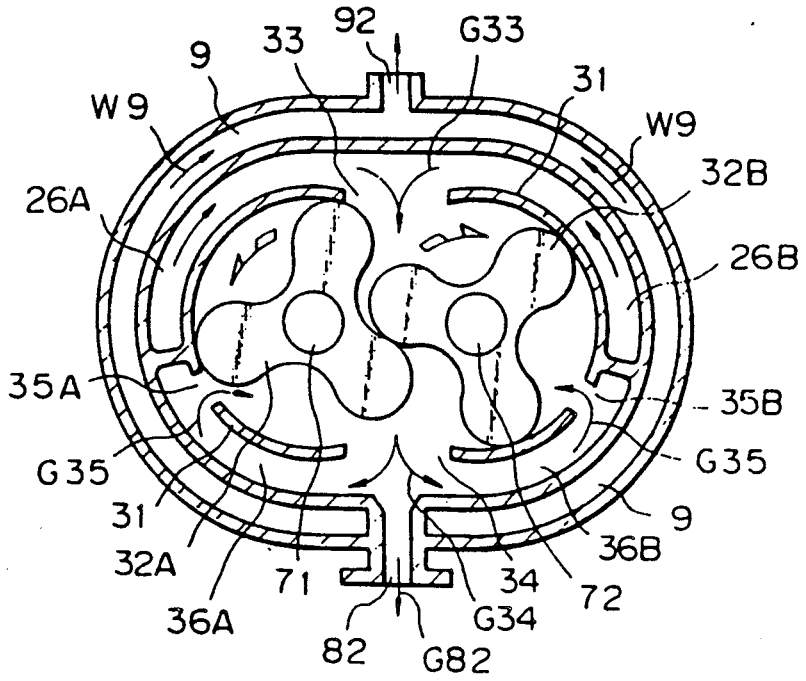

FIGS. 3 to 7 show a reverse flow cooling type 3-section Roots vacuum pump according to an embodiment of the present invention. FIG. 4 shows a cross-sectional view of the pump taken along the plane represented by IV—IV in FIG. 3. FIGS. 5 to 7 show the cross-sectional views taken along the plane represented by V—V, VI—VI, and VII—VII.

Referring to FIG. 3, the first pump section 1 and the second pump section 2 are separated by an intersection wall 4, and the second pump section 2 and the third pump section 3 are separated by an inter-section wall 5. As shown in FIG. 4, the first shaft 71 and the second shaft 72, supported by a bearing mechanism 74, pass through a specific pump section and are made to rotate in opposite directions by a timing gear mechanism 73. The first shaft 71 passes through a shaft sealing mechanism 75 and can be driven by an electric motor.

In FIGS. 3 and 5, the first pump section 1 includes a housing 11 having an inlet 13 and an outlet 14, and rotors 12A and 12B supported by a pair of shafts 71 and 72. A peripheral gas passage 16A, 16B is arranged around the housing 11, and the passage runs through an outlet 14 and inlets 15A, 15B which lead reverse flow cooling gas into the housing 11, and is bound for the next second pump section. A coolant water passage 9 is arranged around the peripheral gas passage 16A, 16B.

In FIGS. 3 and 6, the second pump section 2 includes a housing 21 having an inlet 23 and an outlet 24, and rotors 22A and 22B supported by a pair of shafts 71 and 72. Peripheral gas passages 16A, 16B and 26A, 26B are arranged around the housing 21, and the passage 16A, 16B runs from the previous first section to the inlet 23, and the passage 26A, 26B runs through the outlet 24 and inlets 25A, 25B which lead reverse flow cooling gas into the housing 21, and is bound for the next third pump section. A coolant water passage 9 is arranged around the peripheral gas passages 16A, 16B, 26A, 26B.

In FIGS. 3 and 7, the third pump section 3 includes a housing having an inlet 33 and an outlet 34, and rotors 32A and 32B supported by a pair of shafts 71 and 72. Peripheral gas passages 26A, 26B and 36A, 36B are arranged around the housing 31, and the passage 26A, 26B runs from the previous second pump section to the inlet 33, and the passage 36A, 36B runs through the outlet 34 and the inlet 35A, 35B which leads reverse flow cooling gas into the housing 31, and a coolant water passage 9 is arranged around the peripheral gas passages 26A, 26B, 36A, 36B. The coolant water inlet 91 is connected to the coolant water outlet 92 by the coolant water passage 9 arranged around the peripheral gas passages.

The operation of the pump is now described below with reference to FIGS. 3 to 7.

As shown in FIGS. 3 and 5, in the first pump section 1, intake gas G81 of the pump is drawn from the inlet 13 of the first pump section through the inlet 81 of the pump as intake gas G13, and transmitted by the rotation of the rotors 12A and 12B. In this case, gas is compressed in a reverse flow manner in the housing with only a minimal rise in temperature due to the effect of reverse flow cooling gas G15 which passes through the peripheral gas passage 16A, 16B and flows into the housing through the inlets 15A, 15B for reverse flow cooling gas, and then the compressed gas is discharged to the peripheral gas passage 16A, 16B through the outlet 14 as the discharged gas G14. The discharged gas G14 flows through the peripheral gas passage while radiating heat to the outside wall of the peripheral gas passage 16A, 16B which is effectively cooled by coolant water W9 circulated in the coolant water passage 9, and maintaining the housing 11 at an appropriate warm temperature. The discharged gas G14 is then divided into two portions at the inlet 15A, 15B for reverse flow cooling gas: one portion is reverse flow cooling gas G15 which returns into the housing 11, and another portion is intake gas G23 which is delivered through the inlet 23 of the second pump section.

The intake gas G23 flows through the peripheral gas passage 16A, 16B while radiating heat to the outside wall of the peripheral gas passage 16A, 16B which is effectively cooled by coolant water W9 circulated in the coolant water passage 9, and also maintaining the housing 11 and the housing 21 at an appropriate warm temperature, to the inlet 23 of the second pump section.

As shown in FIGS. 3 and 6, in the second pump section, the intake gas G23 is drawn through the inlet 23 and transmitted by the rotation of the rotors 22A and 22B. In this case, gas is compressed in a reverse flow manner in the housing 21 with only a minimal rise in temperature due to the effect of reverse flow cooling gas G25 which passes through the peripheral gas passage 26A, 26B and flows into the housing 21 through the inlets 25A, 25B for reverse flow cooling gas, and then the compressed gas G24 is delivered to the peripheral gas passage 26A, 26B through the outlet 24 as the discharged gas G24. The discharged gas G24 flows through the peripheral gas passage while radiating heat to the outside wall of the peripheral gas passage 26A, 26B which is effectively cooled by coolant water W9 circulated in the coolant water passage 9, and maintaining the housing 21 at an appropriate warm temperature. The discharged gas G24 is then divided into the reverse flow cooling gas G25 which returns into the housing 21, and the intake gas G33 which is delivered through the inlet 33 of the third pump section. The intake gas G33 flows through the peripheral gas passage 26A, 26B while radiating heat to the outside wall of the peripheral gas passage 26A, 26B which is effectively cooled by coolant water W9 circulated in the coolant water passage 9, and also maintaining the housings 21 and 31 at an appropriate warm temperature, to the inlet 33 of the third pump section.

As shown in FIGS. 3 and 7, in the third pump section, the intake gas G33 is drawn through the inlet 33 and transmitted by the rotation of the rotors 32A and 32B. In this case, gas is compressed in a reverse flow manner in the housing 31 with only a minimal rise in temperature due to the effect of reverse flow cooling gas G35 which passes through the peripheral gas passage 36A, 36B and flows into the housing 31 through the inlets 35A and 35B for reverse flow cooling gas, and then the compressed gas G34 is delivered to the peripheral gas passage 36A, 36B through the outlet 34 as the discharged gas G34. The discharged gas G34 flows through the peripheral gas passage while radiating heat to the outside wall of the peripheral gas passage 36A, 36B which is effectively cooled by coolant water W9 circulated in the coolant water passage 9, and maintaining the housing 31 at an appropriate warm temperature. Then the discharged gas G34 is divided at the outlet 34 into the reverse flow cooling gas G35 and the discharged gas G82 of the pump which is discharged out of the pump through the outlet 82 of the pump. The reverse flow cooling gas G35 flows through the peripheral gas passage 36A, 36B while radiating heat to the outside wall of the peripheral gas passage 36A, 36B which is effectively cooled by coolant water W9 circulated in the coolant water passage 9, and also maintaining the housing 31 at an appropriate warm temperature, into the housing 31 again through the inlets 35A and 35B for the reverse flow cooling gas.

As described above, in the reverse flow cooling type multi-section Roots vacuum pump according to the present invention, gas drawn through the inlet of each pump section to the inside of the housing is transmitted by the rotation of the rotors. In this case, gas is compressed in a reverse flow manner in the housing with only a minimal rise in temperature due to the effect of reverse flow cooling gas which passes through the peripheral gas passage and flows into the housing through the inlet for reverse flow cooling gas, and then the compressed gas is discharged to the peripheral gas passage through the outlet as the discharged gas. The discharged gas flows through the peripheral gas passage while radiating heat to the outside wall of the peripheral gas passage which is effectively cooled by coolant water circulated in the coolant water passage, and maintaining the housing at an appropriate warm temperature. Then the discharged gas is divided at the inlet of reverse flow cooling gas into the reverse flow cooling gas which returns into the housing and the intake gas which flows to the next pump section.

The intake gas flows through the peripheral gas passage which is effectively cooled by coolant water circulated in the coolant water passage, and maintaining the housing at an appropriate warm temperature, to the inlet of the next pump section. The operation described above is performed successively in each pump section.

A detailed description was given of a pump having three sections, but the reverse flow cooling type multi-section Roots vacuum pump according to the present invention may be constituted, not limited to three, but by 4 or more sections. Further, in the case of 4 or more sections, the first section should have the same constitution as shown in FIG. 5, and the final section should have the same constitution as shown in FIG. 7.

We claim:

1. A multi-section Roots vacuum pump of the reverse flow cooling type having a plurality of pump sections each having rotors fixed to two common shafts, said pump comprising:

a housing in each of said pump sections, said housing comprising an inner circumferential wall, an intermediate circumferential wall, an outer circumferential wall, an inlet and an outlet for a gas to be pumped through said housing, and an inner chamber enclosing rotors, said inner chamber being formed by said housing inner circumferential wall;

peripheral gas passages formed between said inner circumferential wall and said intermediate circumferential wall, said inner circumferential wall comprising a plurality of reverse flow cooling inlets extending between said peripheral gas passages and said inner chamber;

peripheral coolant water passages arranged around said peripheral gas passages and formed between said intermediate circumferential wall and said outer circumferential wall;

wherein the gas flowing through said inlet into said housing and delivered through said outlet is supplied to said peripheral gas passages for cooling, and at least a portion of the cooled gas is returned into said inner chamber through said inner circumferential wall reverse flow cooling inlets, and the remaining portions of the gas which are not returned into the housing in the pump sections except for the last pump section are supplied to the inlet of the next pump section through said peripheral gas passage.

* * * * *

UNITED STATES PATENT AND TRADEMARK OFFICE

CERTIFICATE OF CORRECTION

PATENT NO. : 4,995,796

DATED : February 26, 1991

INVENTOR(S) : Shigeharu Kambe, Tutomu Higuchi

It is certified that error appears in the above-identified patent and that said Letters Patent is hereby corrected as shown below:

In the abstract, line 6, delete "a" after the word "rotors".

In the Abstract, line 7, delete "a" before the word "peripheral".

In the Abstract, line 8, "arraged" should read --arranged--.

Signed and Sealed this

Eighteenth Day of August, 1992

*Attest:*

DOUGLAS B. COMER

*Attesting Officer*

*Acting Commissioner of Patents and Trademarks*